US005406996A

United States Patent [19]

Wagner et al.

[11] Patent Number: 5,406,996

[45] Date of Patent: Apr. 18, 1995

[54] BOTTLED WATER LIFTING APPARATUS

[76] Inventors: Larry L. Wagner, 4375 Dale Dr., Napa, Calif. 94558; Wade C. Ballard, 1605 F St., Apt. A, Napa, Calif. 94559

[21] Appl. No.: 197,936

[22] Filed: Feb. 17, 1994

[51] Int. Cl.[6] ..... B65B 1/04; B65B 3/00; B67C 3/00

[52] U.S. Cl. ..... 141/364; 141/391; 414/420; 414/422; 414/621

[58] Field of Search ..... 141/364, 231, 284, 348, 141/351, 352, 374, 375, 391; 414/420, 422, 621

[56] References Cited

U.S. PATENT DOCUMENTS

| | | | |
|---|---|---|---|
| 2,109,034 | 10/1935 | Alex | 62/141 |
| 3,868,033 | 2/1975 | Le Duff | 214/707 |
| 3,934,772 | 1/1976 | Brannan | 224/45 |
| 4,036,382 | 7/1977 | Perry et al. | 214/313 |
| 4,632,627 | 12/1986 | Swallows | 414/490 |
| 4,737,065 | 4/1988 | Ju | 414/490 |
| 4,797,050 | 1/1989 | Habicht | 414/420 |
| 4,834,438 | 5/1989 | Haidet | 294/31.2 |
| 5,104,135 | 4/1992 | Sheets | 280/47.19 |
| 5,288,200 | 2/1994 | Burgers et al. | 414/758 |

*Primary Examiner*—Renee S. Luebke
*Assistant Examiner*—Steven O. Douglas
*Attorney, Agent, or Firm*—Larry D. Johnson

[57] ABSTRACT

An apparatus to transport and place a water bottle onto a water dispenser includes an upright frame member having a base portion and a top portion, the base having a pair of strut elements adapted to fit around the sides of the water dispenser without interference. A vertically-movable and horizontal-axis swivelling bottle clamp arm portion extends in a direction parallel to the struts. The clamp arm is supported on the upright frame so that it may be raised and lowered, such as by a winch and cable arrangement. The bottle clamp arm terminates in a pivotable clamp member adapted for releasable capture of a water bottle.

10 Claims, 4 Drawing Sheets

BOTTLED WATER LIFTING APPARATUS

BACKGROUND OF THE INVENTION

1. Field of the Invention

This invention relates generally to hand trucks and other transport apparatus, and more specifically to an improved lifting apparatus for the transport and installation of drinking water bottles and the like.

2. Description of the Prior Art

Bottled water dispensers are well known, and typically comprise a dispenser base having an upwardly-exposed reservoir for receipt of an inverted bottle of water, and a faucet or other valve for selective water dispensing. Many dispensers also include refrigeration and/or heating features for the water to be dispensed.

The water bottles for such dispensers typically contain five to six gallons of water, and therefore weigh forty to fifty pounds when filled. It is often awkward and cumbersome to lift these bottles, and then invert them over the dispenser reservoir for use.

SUMMARY OF THE INVENTION

The bottled water lifting apparatus of this invention provides a versatile device to transport and place a typical water bottle onto a typical water dispenser such that the water bottle spout is aligned with and inserted into the water dispenser reservoir. The operative components of the apparatus include an upright frame member having a base portion and a top portion, the base portion having a pair of strut elements adapted to fit around the sides of the water dispenser without interference. The base portion and struts can be equipped with a set of wheels and casters, respectively, to enable movement of the apparatus across the floor. The apparatus further includes a vertically-movable and horizontal-axis swivelling bottle clamp arm portion extending in a direction generally parallel to the strut elements (so that the clamp arm holding the water bottle can be positioned over the water dispenser). The clamp arm portion is supported on the upright frame member so that it may be raised and lowered relative to the upright frame member, such as by a winch and cable arrangement. The bottle clamp arm portion terminates in a pivotable water bottle clamp member adapted for releasable capture of a water bottle.

The purpose of the bottled water lifting apparatus of this invention is to lift and transport five and six gallon water bottles. The apparatus preferably has four wheels; the front two being casters for better maneuverability. The back two wheels are hand truck type wheels to enable the user to be able to bring water bottles up stairs. The apparatus can encompass a water bottle, clamp on to it, lift it up (even a slight distance is adequate) and transport it anywhere in an office or a home. Once the apparatus is positioned in front of a water cooler (dispenser) the user can winch the attached water bottle up higher than the water cooler, release the swivel on the clamp arm, turn the bottle over and move the unit over the top of the water cooler (the base of the apparatus is designed to go around a standard water dispenser, thereby enabling it to hold the water bottle directly over the dispenser). Then, the user can winch the inverted bottle down close to the water cooler reservoir, pull the plastic seal off of the water bottle spout, and lower the water bottle onto the water cooler. The bottle clamp may then be unfastened to release the water bottle, and the apparatus moved away from the water cooler.

Figure 2:
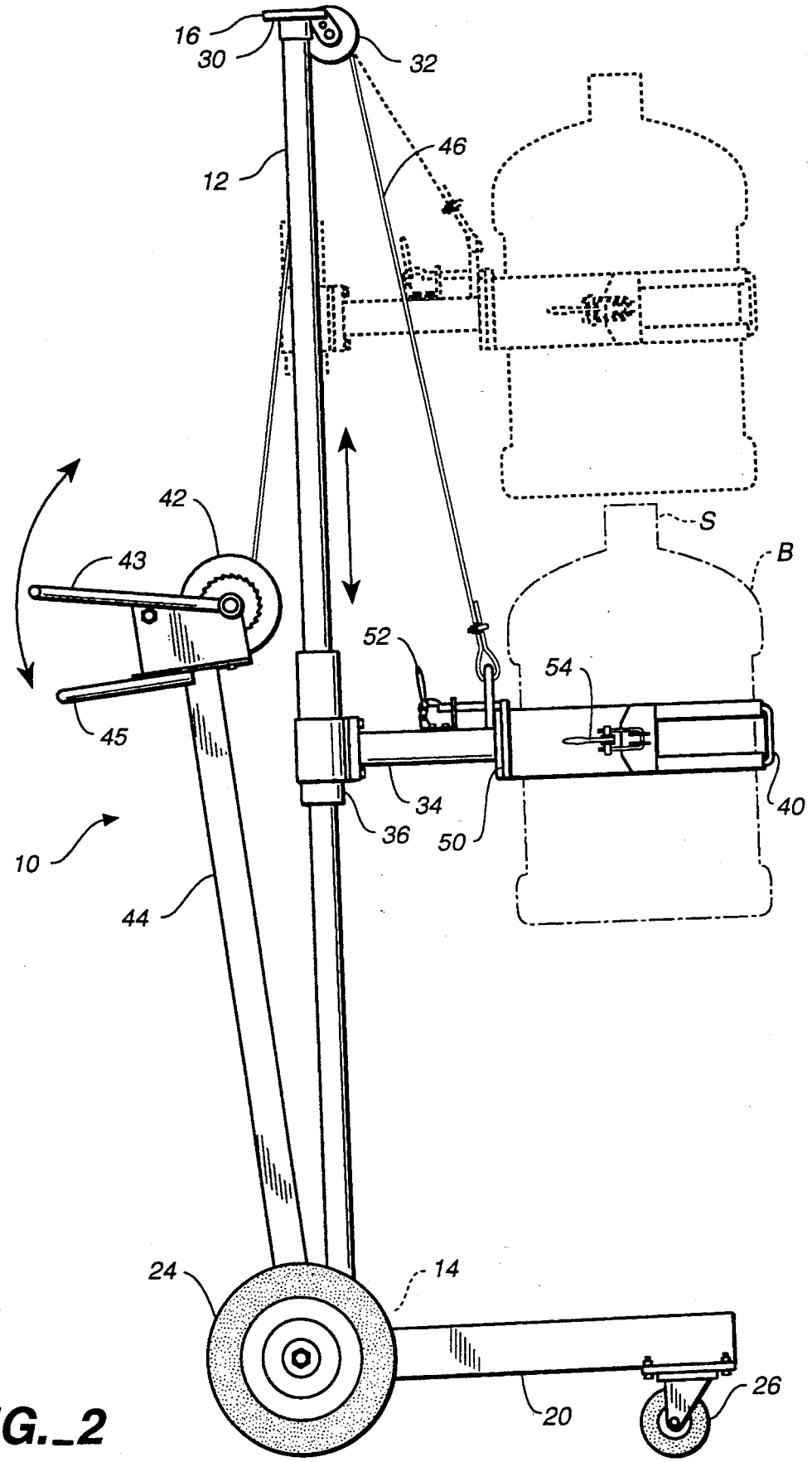
Figure 3:
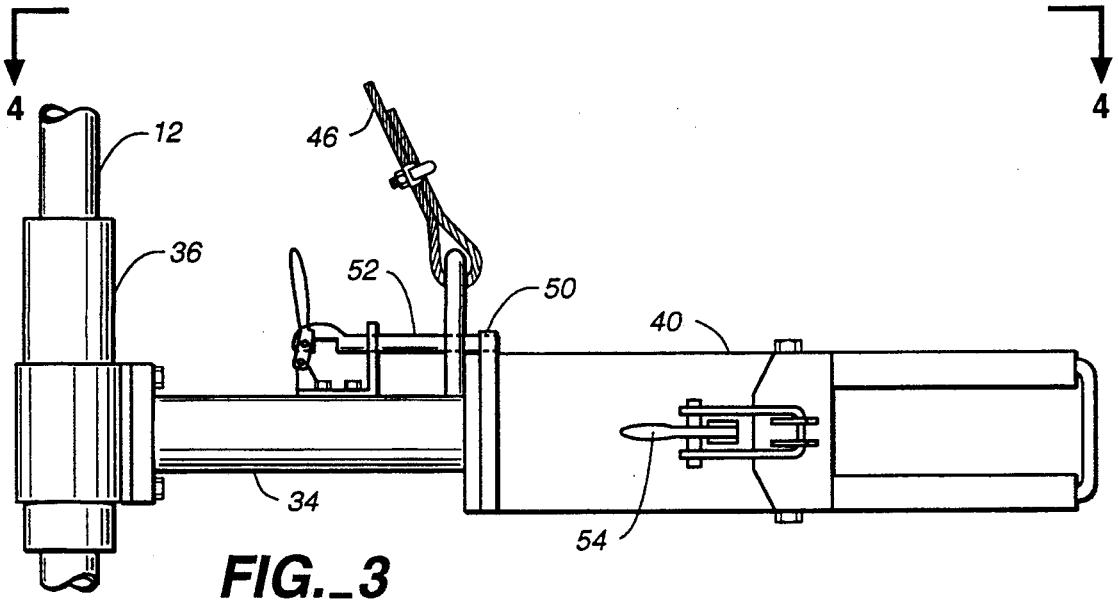
Figure 3A:
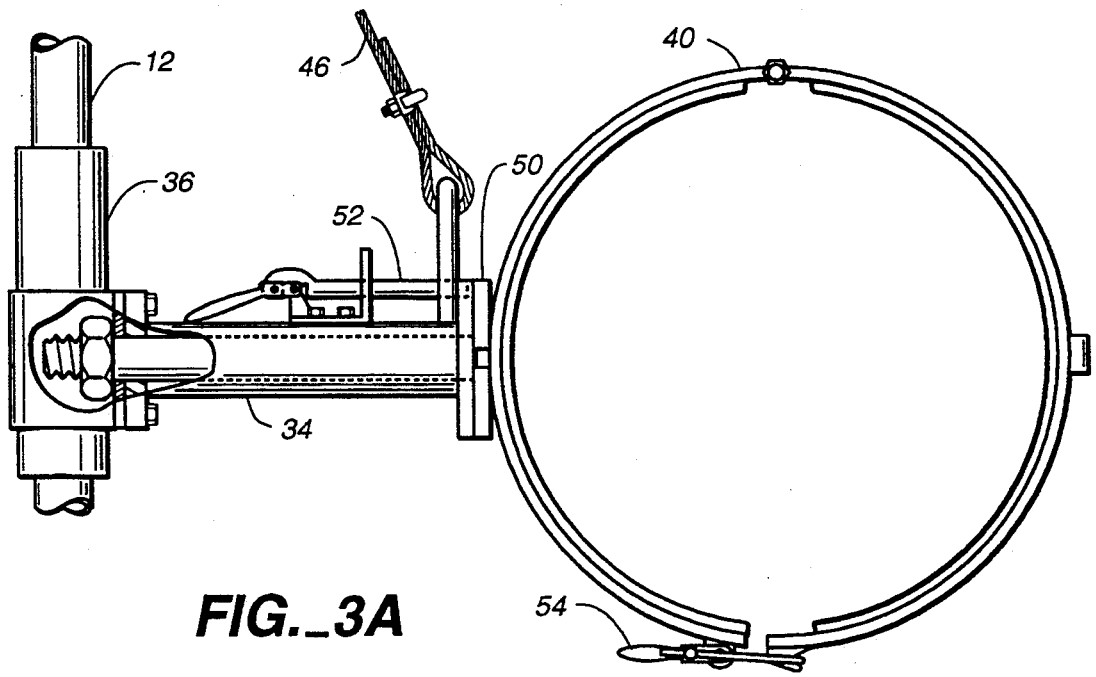
Figure 4:
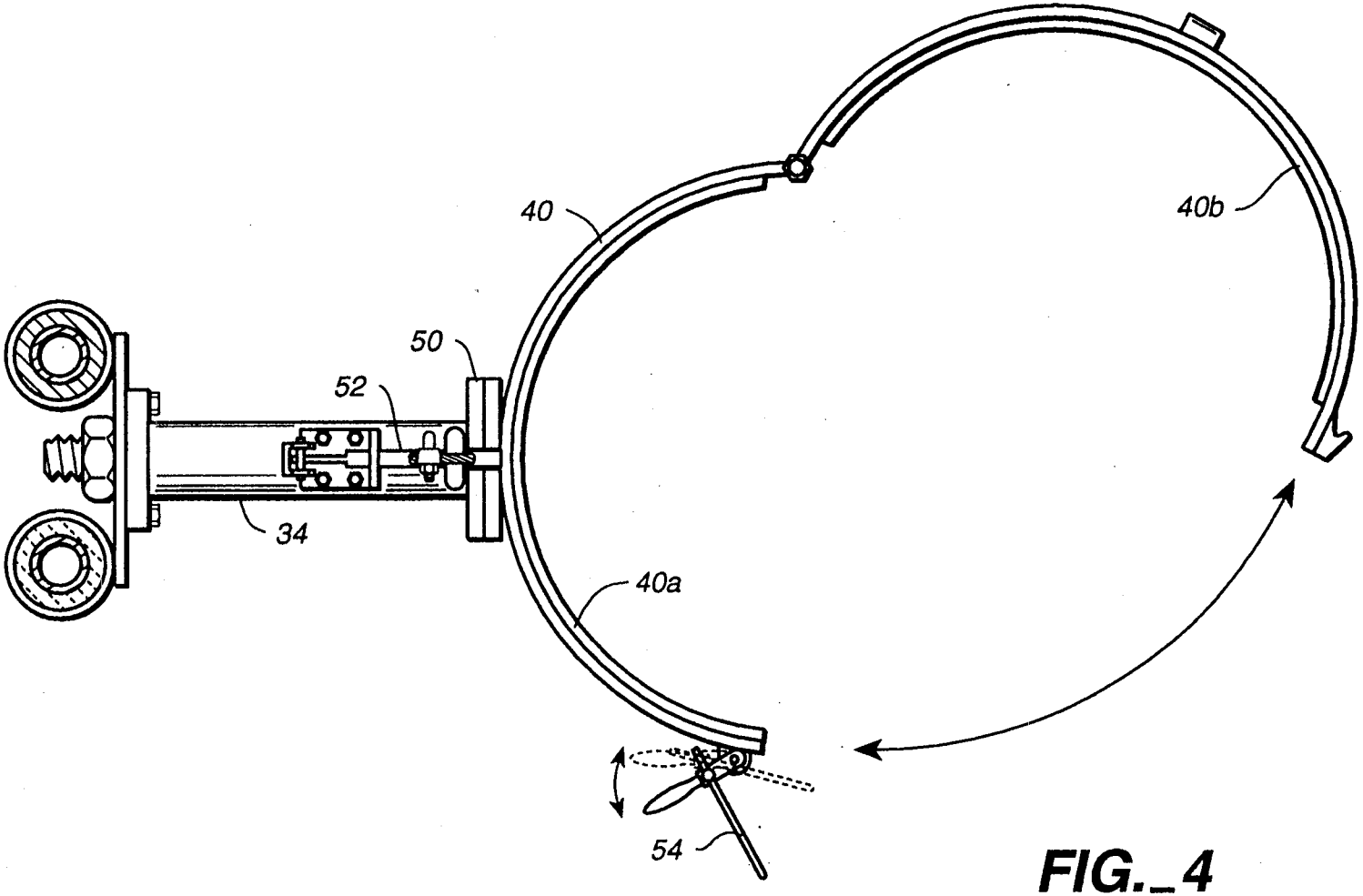

an upright frame member having a base portion and a top portion, the base portion having a pair of strut elements adapted to fit around the sides of the water dispenser without interference, the base portion and struts equipped with a set of wheels and casters, respectively, to enable movement of the apparatus across the floor; the frame member top portion having a top plate bearing a pulley;

a vertically-movable and horizontal-axis swivelling bottle clamp arm portion extending in a direction generally parallel to the strut elements and supported on the upright frame member by at least one collar or bushing member adapted for vertical sliding engagement with the upright frame member, the bottle clamp arm portion terminating in a pivotable water bottle clamp member adapted for releasable capture of a water bottle; and a crank or winch member having a winch handle and attached to the base portion by a winch support having an apparatus handle, the winch member being connected to the bottle clamp arm portion by a cable directed through the top plate pulley;

FIG. 2 is a side elevation view of the bottled water dispenser apparatus of this invention showing a water bottle captured in the bottle clamp being raised from a first position to a second position by retraction of the cable onto the winch member; this view illustrating further operative components of the apparatus including a clamp arm swivel and swivel latch enabling selective rotation of the bottle clamp about the clamp arm horizontal axis, and a bottle clamp release enabling secure capture and release of a water bottle;

FIG. 3 is a side elevation view of the clamp arm portion of the bottled water lifting apparatus of this invention, illustrating the swivel latch engaged into the swivel, thereby locking the bottle clamp in its vertical (lifting and transport) position;

FIG. 3A is a partially cutaway side elevation view of the clamp arm portion of the bottled water lifting apparatus of this invention, illustrating the swivel latch having been disengaged from the swivel, thereby enabling the bottle clamp to be pivoted about the horizontal axis of the clamp arm for rotation and placement of a water bottle; and FIG. 4 is a top plan view of the (vertically-sliding and horizontal-axis swivelling) clamp arm portion of the bottled water lifting apparatus of this invention, illustrating the bottle clamp release having been unfastened to open up the bottle clamp clamshell halves for capture or release of a water bottle, this view taken along line 4—4 of FIG. 3.

DETAILED DESCRIPTION OF A PREFERRED EMBODIMENT

Figure 1:
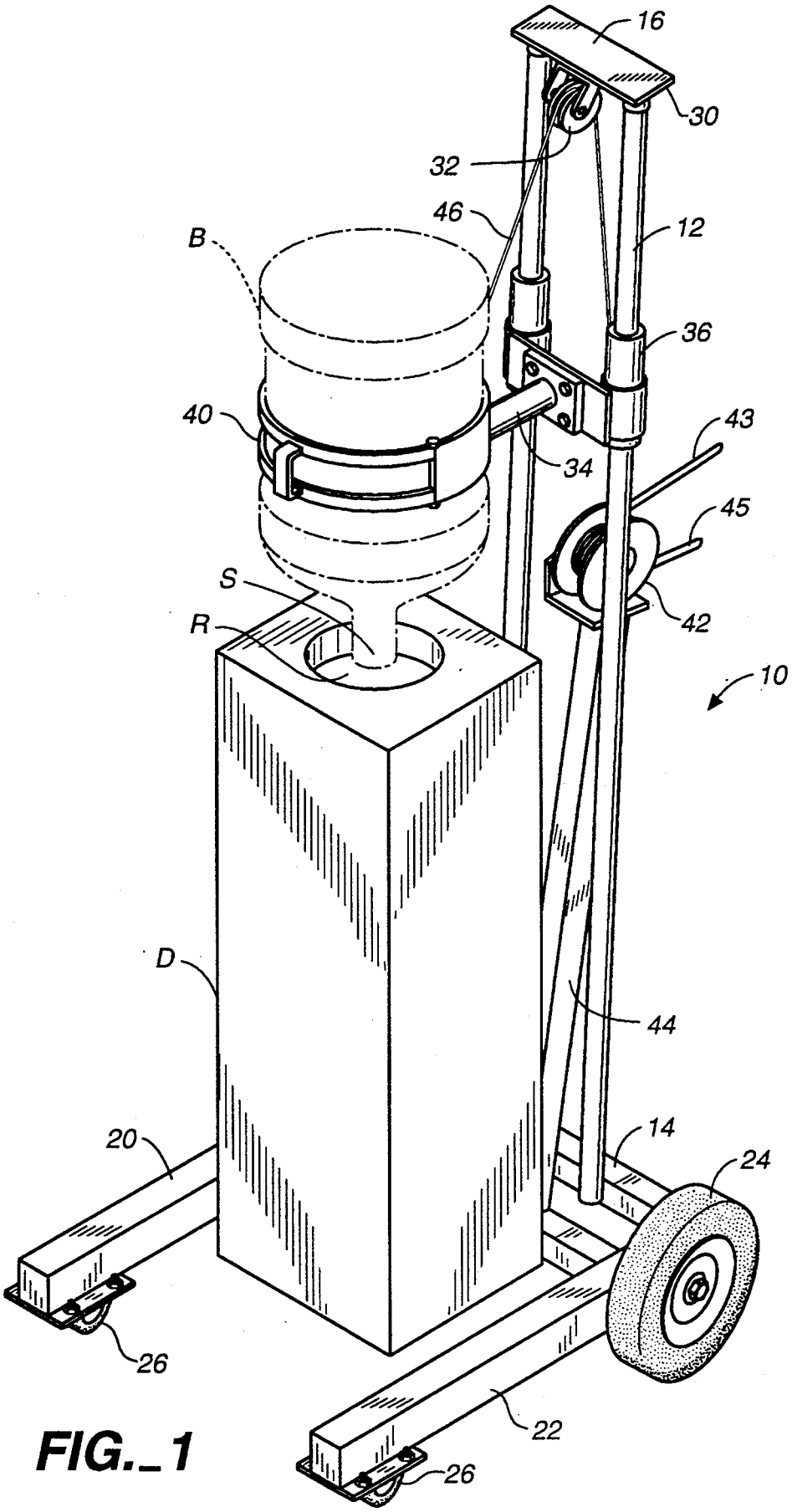
FIG. 1 is a perspective view of a bottled water lifting apparatus of this invention in use to place a typical water bottle onto a typical water dispenser such that the water bottle spout is aligned with and inserted into the water dispenser reservoir; and illustrating the operative components of the apparatus including.

FIG. 1 is a perspective view of a bottled water lifting apparatus 10 of this invention in use to place a typical water bottle B onto a typical water dispenser D such that the water bottle spout S is aligned with and inserted into the water dispenser reservoir R. This view illustrates the operative components of the apparatus including an upright frame member 12 made of one inch O.D. tubing or similar material and having a base portion 14 and a top portion 16, the base portion having a pair of strut elements 20, 22 adapted to fit around the sides of the water dispenser D without interference. The base portion and struts are equipped with a set of eight-inch rubber wheels 24 and three-inch swivel casters 26, respectively, to enable movement of the apparatus across the floor. The frame member top portion 16 has a top plate 30 bearing a pulley 32.

A vertically-movable and horizontal-axis swivelling bottle clamp arm portion 34 made of 1½" steel tubing or similar material extends in a direction generally parallel to the strut elements 20, 22 and is supported on the upright frame member 12 by at least one collar or bushing member 36 which is adapted for vertical sliding engagement with the upright frame member 12. The bottle clamp arm portion terminates in a pivotable water bottle clamp member 40 adapted for releasable capture of a water bottle B, such as an 11¼" diameter steel and rubber clamp, and preferably engages the circumferential depression formed in many standard water bottles.

A crank or winch member 42 having a winch handle 43 is attached to the base portion 14 by a winch support 44 made of mild steel rectangular tubing or similar material and preferably having an apparatus handle 45. The winch member 42 is connected to the bottle clamp arm portion 34 by a cable 46 directed through the top plate pulley 32.

FIG. 2 is a side elevation view of the bottled water dispenser apparatus 10 of this invention showing a water bottle B (in phantom) captured in the bottle clamp 40 and being raised from a first position to a second (higher) position (in phantom) by retraction of the cable 46 onto the winch member 42. This view illustrates further operative components of the apparatus 10 including a clamp arm swivel 50 and swivel latch 52 enabling selective rotation of the bottle clamp 40 about the clamp arm 34 horizontal axis, and a bottle clamp release 54 enabling secure capture and release of the water bottle.

Other lifting mechanisms could be employed. For example, a vertical screw jack could be used to drive the bottle clamp arm up or down relative to the upright frame.

FIG. 3 is a side elevation view of the clamp arm portion 34 of the bottled water lifting apparatus of this invention, illustrating the swivel latch 52 engaged into the swivel 50, thereby locking the bottle clamp 40 in its vertical (lifting and transport) position. It is preferable to keep the swivel latched during transport for stability.

FIG. 3A is a partially cutaway side elevation view of the clamp arm portion 34 of the bottled water lifting apparatus of this invention, illustrating the swivel latch 52 having been disengaged from the swivel 50, thereby enabling the bottle clamp 40 to be pivoted about the horizontal axis of the clamp arm 34 for rotation and placement of a water bottle onto a water dispenser. The swiveling of the bottle clamp is thus independent of the vertical adjustability of clamp arm 34 relative to upright frame 12.

FIG. 4 is a top plan view of the (vertically-sliding and horizontal-axis swivelling) clamp arm portion 34 of the bottled water lifting apparatus of this invention, illustrating the bottle clamp release 54 having been unfastened to open up the bottle clamp 40 clamshell halves **40*a*, 40*b* for capture or release of a water bottle (this view taken along line 4—4 of FIG. 3**). Alternatively, the bottle clamp could consist of webbing straps or other means to releasibly secure a water bottle to the clamp arm.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A bottled water lifting apparatus to transport and place a water bottle onto a water dispenser such that the water bottle spout is aligned with and inserted into the water dispenser reservoir, said apparatus comprising:

an upright frame member having a base portion and a top portion, said base portion having a pair of strut elements adapted to fit around the sides of said water dispenser without interference;

a swivelling bottle clamp arm portion extending in a direction generally parallel to said strut elements, said bottle clamp arm portion supported on said upright frame member so that it may be vertically raised and lowered relative to said upright frame member, said bottle clamp arm portion terminating in a water bottle clamp member pivotable horizontally relative to said upright frame member and adapted for releasable capture of a water bottle; and winch and cable means for raising and lowering said bottle clamp arm portion relative to said upright frame member.

2. The bottled water lifting apparatus of claim 1 including a winch member having a winch handle attached to said base portion by a winch support, said winch member connected to said bottle clamp arm portion by a cable directed through said top portion.

3. The bottled water lifting apparatus of claim 1 wherein said base portion includes wheels to enable movement of said apparatus.

4. The bottled water lifting apparatus of claim 1 wherein said strut elements include casters to enable movement of said apparatus.

5. A bottled water lifting apparatus to transport and place a water bottle onto a water dispenser such that the water bottle spout is aligned with and inserted into the water dispenser reservoir, said apparatus comprising:

an upright frame member having a base portion and a top portion, said base portion having a pair of strut elements adapted to fit around the sides of said water dispenser without interference;

a swivelling bottle clamp arm portion extending in a direction generally parallel to said strut elements, said bottle clamp arm portion supported on said upright frame member by at least one collar member adapted for vertical sliding engagement with said upright frame member so that it may be vertically raised and lowered relative to said upright frame member, said bottle clamp arm portion terminating in a water bottle clamp member pivotable horizontally relative to said upright frame member and adapted for releasable capture of a water bottle; and means for raising and lowering said bottle clamp arm portion relative to said upright frame member.

6. The bottled water lifting apparatus of claim 5 wherein said base portion includes wheels to enable movement of said apparatus.

7. The bottled water lifting apparatus of claim 5 wherein said strut elements include casters to enable movement of said apparatus.

8. A bottled water lifting apparatus to transport and place a water bottle onto a water dispenser such that the water bottle spout is aligned with and inserted into the water dispenser reservoir, said apparatus comprising:

an upright frame member having a base portion and a top portion, said base portion having a pair of strut elements adapted to fit around the sides of said water dispenser without interference;

a swivelling bottle clamp arm portion extending in a direction generally parallel to said strut elements, said bottle clamp arm portion supported on said upright frame member so that it may be vertically raised and lowered relative to said upright frame member, said bottle clamp arm portion having a horizontal axis and including a clamp arm swivel and swivel latch enabling selective rotation of said bottle clamp about said horizontal axis, said bottle clamp arm portion terminating in a water bottle clamp member adapted for releasable capture of a water bottle; and means for raising and lowering said bottle clamp arm portion relative to said upright frame member.

9. The bottled water lifting apparatus of claim 8 wherein said base portion includes wheels to enable movement of said apparatus.

10. The bottled water lifting apparatus of claim 8 wherein said strut elements include casters to enable movement of said apparatus.

* * * * *